United States Patent [19]

Morley

[11] 3,942,734

[45] Mar. 9, 1976

[54] TAPE CARTRIDGE

[76] Inventor: E. Dean Morley, 743 Lowton St., McLean, Va. 22101

[22] Filed: Feb. 12, 1975

[21] Appl. No.: 549,368

Related U.S. Application Data

[63] Continuation of Ser. No. 363,880, May 25, 1973, abandoned.

[52] U.S. Cl. ..... 242/55.19 A

[51] Int. Cl.[2] ..... B65H 17/48

[58] Field of Search ..... 242/55.19 A; 352/128, 72, 352/78; 179/100.2 Z; 360/93

[56] References Cited

UNITED STATES PATENTS

| | | | |
|---|---|---|---|
| 2,699,332 | 1/1955 | MacKenzie | 242/55.19 A |
| 2,830,812 | 4/1958 | Nash | 242/55.19 A |
| 2,917,308 | 12/1959 | Woelfel | 242/55.19 A |
| 3,489,362 | 1/1970 | Linning | 242/55.19 A |
| 3,606,191 | 9/1971 | Ban | 242/55.19 A |
| 3,617,010 | 11/1971 | Coy | 242/55.19 A |
| 3,708,135 | 1/1973 | Lace | 242/55.19 A |

*Primary Examiner*—Edward J. McCarthy
*Attorney, Agent, or Firm*—Edwin E. Greigg

[57] ABSTRACT

A cartridge for an endless magnetic tape which includes a tape reel, a pressure roller and a drive connection between the pressure roller and a portion of the tape reel. In this way, the pressure roller can be utilized to drive that portion of the tape reel with which it is connected. The tape reel comprises two discs each having a hub portion. The hub portions serve to align the discs in assembly. One of the discs has a plurality of rollers concentrically arranged with respect to its hub portion around which a tape roll is formed. The other disc has a plurality of tape-engaging ribs extending outwardly from one surface and a rotation imparting structure extending outwardly from the other surface.

1 Claim, 2 Drawing Figures

FIG. 1
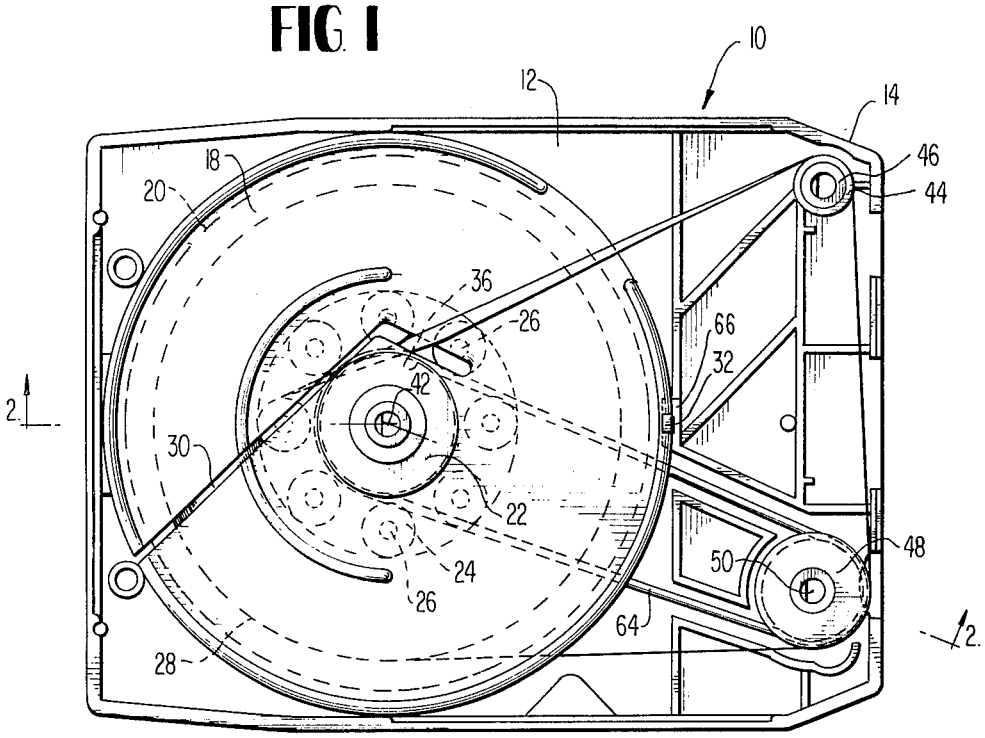
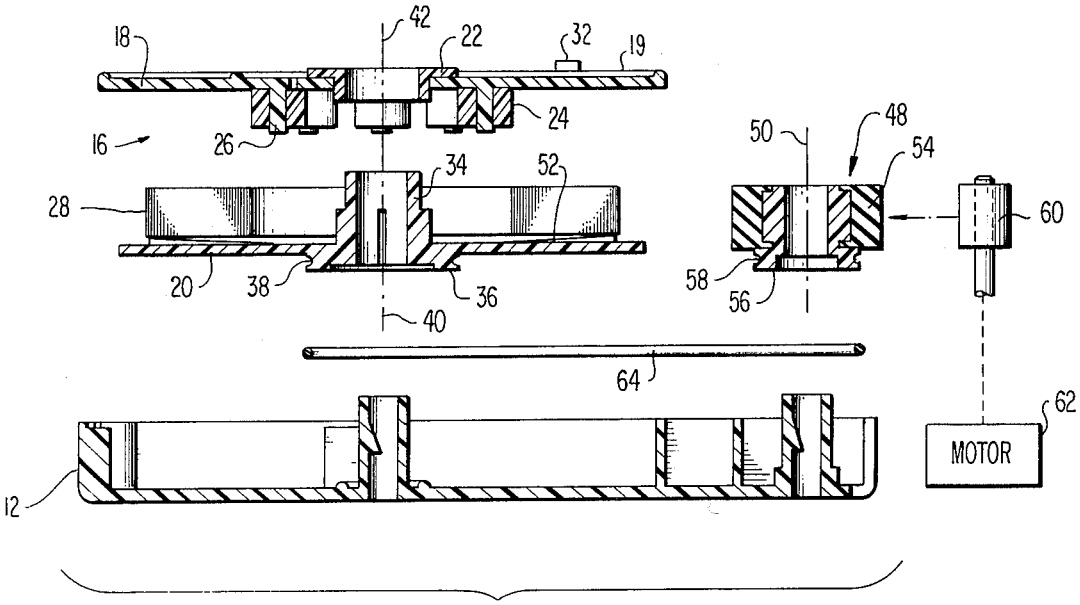
FIG. 2

TAPE CARTRIDGE

RELATED APPLICATION

The present application is a continuation of application Ser. No. 363,880, filed May 25, 1973, now abandoned.

BACKGROUND OF THE INVENTION

The present invention relates to a tape cartridge, and more particularly to a means for driving the tape cartridge.

Many known types of tape cartridges for endless magnetic tapes, provide relatively complex assemblies, which adds to the cost of the cartridge and reduces its reliability.

It would therefore be desirable to have a tape cartridge for an endless magnetic tape which is simplified, from an assembly standpoint, and is more reliable from an operational standpoint.

OBJECTS AND SUMMARY OF THE INVENTION

It is, therefore, a general object of the present invention, to provide an improved tape cartridge for an endless magnetic tape which is significantly simplified from an assembly and operational standpoint.

It is a more specific object of the present invention to provide a tape cartridge for an endless magnetic tape which is simplified in its means for driving the tape.

These and other objects are accomplished according to the present invention by the provision of a cartridge including a disc, a stationarily retained tape roll forming means, a pressure roller, and means connecting the pressure roller to the disc for imparting rotation to the disc and to the tape roll formed on the tape roll forming means in relation to the rotation of the pressure roller.

BRIEF DESCRIPTION OF THE DRAWINGS

FIG. 1 is a top plan view with portions cut away illustrating the tape cartridge according to the present invention.

FIG. 2 is an exploded view in elevation illustrating the elements comprising the tape reel, the pressure roller and the drive connection between the pressure roller and the tape reel along with means for driving the pressure roller.

DESCRIPTION OF THE PREFERRED EMBODIMENT

Turning now more specifically to the drawing, there is shown a tape cartridge 10 including a top housing portion 12 and a lower housing portion 14. These housing portions are preferably molded of a styrene plastic material. Details of the housing portions 12 and 14 are not shown, however, they include known means for forming an assembly of the two portions and for mounting a tape reel 16, an idler roller 44, and a pressure roller 48 thereto.

The tape reel 16 includes an upper disc 18 and a lower disc 20, both of which are fabricated of a preferably light weight synthetic material. Mounted through a central bore in the upper disc 18 is a hub 22. Surrounding the hub 22 are a plurality of equally spaced tape roll forming rollers 24. The rollers 24 are mounted on pins 26 which extend from the surface of the disc 18. The tape roll forming rollers 24 serve as a hub portion for the formation of a tape roll from an endless magnetic tape 28. Within the disc 18 there is formed a slot 30 through which the tape 28 passes from the roll formed by the tape roll forming rollers 24 toward the recording or reproducing heads (not shown). The disc 18 is preferably provided with a segmented annular rib 19. Extending from the upper surface of the disc 18 is an abutment member 32 formed preferably integrally with the rib 19, which cooperates with an appropriate stop means or slot 66 shown dotted in FIG. 1 formed in the top housing portion 12 to ensure that the disc 18 remains stationary.

It should be understood that, alternatively, the abutment member could be formed on the housing portion 12 and the slot formed in the rib 19.

The lower disc 20 includes a hub 34 which engages with the hub 22 of the disc 18 during the assembled state of the tape reel 16. Extending from the disc 20 in the opposite direction from the hub 34 is an extension member 36 having an annular groove 38 formed therein. The extension 36 serves as a rotation imparting means to the disc 20.

The hub 34 and extension 36 define a first axis or axis of rotation 40 of the disc 20 while the hub 22 defines a coincident axis 42. The idler roller 44 is mounted for rotation to a second axis 46 while the pressure roller 48 is mounted for rotation about a third axis 50.

In the assembled reel 16 the tape roll is rotated by the pressure roller 48 along with the disc 20. In a known manner, the tape 28 is drawn from the inner radius of the roll through the slot 30 around the idler roller 44 and the pressure roller 48 where it is taken up on the outside radius of the tape roll. The tape 28 is drawn through the slot 30 so that an appropriate side thereof will be presented to the recording or reproducing heads between the idler roller 44 and the pressure roller 48.

In order to provide a minimum amount of frictional drag to the movement of the tape 28, ribs 52 are provided on the top surface of the disc 20. Preferably at least four such ribs are provided. The ribs 52 in their extent toward the outer edge of the disc 20 are inclined upwardly such that only a limited portion of the tape roll near the outer radius thereof engages the ribs.

To drive the disc 20, the pressure roller 48 is preferably fabricated to include a tape engaging body 54, which is preferably made of hard rubber, and an extension member 56 having an annular groove 58 formed therein. The extension member 56 defines a rotation transmitting means for the disc 20. The tape engaging body 54 engages a capstan 60 which, in turn, is driven by a motor 62. In this way the pressure roller 48 receives a driving torque from the drive means (capstan 60 and motor 62) of the recording or reproducing device with which the cartridge is to be used. To transmit the torque imparted to the pressure roller 48 by the capstan 60, a preferably flexible endless member 64, which may be an O-ring, is utilized. The flexible member is received within the grooves 38 and 58, respectively, with a sufficient tension being developed in the flexible member 64 so that the driving motion can be imparted to the disc 20.

The diameter of the annular groove 38 is preferably slightly greater than the diameter of the annular groove 58 so that the disc 20 will rotate at a slightly lower rate than the pressure roller 48.

The cartridge housing has formed therein a slot 66 within which a member (not shown) of the recording or reproducing device is received for retaining the cartridge 10 in proper alignment within the recording or reproducing device.

As a result of the present invention, a much simplified tape cartridge from the standpoint of structure and operation is disclosed. Driving the disc 20 directly from the tape advancing pressure roller 48 and not through an intermediate transmission, significantly simplifies the overall assembly and increases the efficiency of operation and reliability of the tape cartridge.

What is claimed is:

1. A cartridge for an endless magnetic tape, comprising:

a. a housing;

b. a disc mounted within said housing for rotation relative thereto and about a first axis, said disc including rotation imparting means extending from one surface thereof, a hub portion extending from the other surface thereof, said rotation imparting means and said hub portion defining said first axis, and a plurality of tape engaging ribs which extend outwardly from the other surface thereof;

c. tape roll forming means mounted within said housing to be stationary therewith and defining an axis coincident with said first axis, said tape roll forming means including a further disc provided with a slot through which a magnetic tape passes, a hub portion extending from said further disc and defining said coincident axis and a plurality of annularly spaced rollers also extending from said further disc and concentrically arranged about said portion, with the two hub portions forming aligning means for the assembly of said disc and tape roll forming means into a tape reel, and with said rollers forming a hub about which a magnetic tape is spirally wound c. a first roller mounted within said housing for rotation relative thereto and about a second axis, said roller including tape engaging means;

d. a second roller mounted within said housing for rotation relative thereto and about a third axis, said roller including tape-engaging means and rotation transmitting means;

e. an endless magnetic tape spirally wound into a roll about said tape roll forming means, said tape extending from the inner radius of said tape roll through the slot in said further disc into engagement with the tape engaging means of said first and second roller to define thereby a predetermined path of travel; and f. means connecting said rotation imparting means and said rotation transmitting means for imparting rotation to said disc and tape roll in relation to the rotation of said second roller, wherein:

i. said rotation transmitting means comprises an extension of said second roller;

ii. said rotation imparting means and said rotation transmitting means form annular grooves within which said connecting means are received;

iii. the diameter of the annular groove defined by said rotation imparting means is greater than the diameter of said rotation transmitting means' iv. said second roller exclusive of said rotation transmitting means is formed of rubber;

v. said connecting means is a flexible endless member; and vi. said ribs have inclined surfaces which increase in height in their extent away from said hub portion such that only a limited portion of the tape roll near the outer radius thereof engages said ribs.

* * * * *